United States Patent [19]

Pfeil

[11] Patent Number: 4,907,942

[45] Date of Patent: Mar. 13, 1990

[54] ARRANGEMENT FOR SEPARATING PAPER SHEET PADS FROM A STACK

[75] Inventor: Dieter Pfeil, Leingarten, Fed. Rep. of Germany

[73] Assignee: Schneider GmbH & Co., Heilbronn, Fed. Rep. of Germany

[21] Appl. No.: 86,571

[22] Filed: Aug. 17, 1987

[30] Foreign Application Priority Data

Aug. 29, 1986 [DE] Fed. Rep. of Germany ..... 3629491

[51] Int. Cl.[4] ..... B65G 59/06

[52] U.S. Cl. ..... 414/798; 221/238; 414/796.1; 414/797.4

[58] Field of Search ..... 221/238; 414/115, 125, 414/128, 129, 114, 796.1, 797.4, 798, 798.1, 797.8

[56] References Cited

U.S. PATENT DOCUMENTS

| | | | |
|---|---|---|---|
| 2,594,241 | 4/1952 | Williamson | 414/115 X |
| 3,690,476 | 9/1972 | Stacey | 414/115 |
| 4,252,483 | 2/1981 | Pfaffle | 414/115 |
| 4,456,242 | 6/1984 | Morin | 414/128 X |
| 4,648,772 | 3/1987 | Hartlage | 414/115 |

*Primary Examiner*—Robert J. Spar
*Assistant Examiner*—Janice Krizek
*Attorney, Agent, or Firm*—Horst M. Kasper

[57] ABSTRACT

A method and an arrangement of the present invention are intended for individualizing non-glued paper pads having cardboard backs from a stack which includes a plurality of cut paper layers and intermediate cardboard sheet layers. One end of the stack which is covered by a respective cardboard end sheet is positioned against a support in such a manner that a part of the stack projects freely beyond an edge of the support. A bending force which is directed at an inclination with respect to the stack end and has a component that points toward the edge of the support is applied against an engagement location disposed at a cut surface of the projecting part of the stack to bend the portion of the stack that is situated between the engagement location and the end sheet with attendant formation of a wedge-shaped gap between this portion and the remainder of the stack. A number of the bent-away paper layers and intermediate cardboard layers if flipped under the influence of their elastic restoration forces back to the remainder of the stack by moving the engagement location to which the bending force is applied in the direction of the one end of the stack to such an extent that ultimately the penulitimate one of the paper layers and the last one of the intermediate cardboard sheets is flipped back and only the last one of the paper layers and the cardboard end sheet associated therewith are still bent away.

19 Claims, 5 Drawing Sheets

ARRANGEMENT FOR SEPARATING PAPER SHEET PADS FROM A STACK

BACKGROUND OF THE INVENTION

The present invention relates to separation of paper sheet pads from a stack in general, and more particularly to a method of and an arrangement for separating non-glued paper sheet pads having cardboard backs from a stack that includes a plurality of paper layers that are cut at their circumference, and intermediate cardboard sheets situated between the individual paper layers.

Each of the paper layers contains a counted number of paper sheets and is separated from the adjacent paper layer by the intermediate cardboard sheets that ultimately constitute the cardboard backs of the respective finished paper pads. It is necessary for a following perforating operation or for any other following operation to individualize and separate the paper pads. So far, such separating and individualizing operations have been conducted manually and, consequently, they were very labor-intensive and hence expensive.

SUMMARY OF THE INVENTION

Accordingly, it is a general object of the present invention to avoid the disadvantages of the prior art.

More particularly, it is an object of the present invention to provide a method of separating paper pads from a stack, which method does not possess the drawbacks of the known methods of this type.

Still another object of the present invention is to devise a method of the type here under consideration which lends itself to full automation.

A concomitant object of the present invention is to develop an arrangement capable of performing the above method.

It is yet another object of the present invention so to construct the arrangement of the above type as to be relatively simple in construction, inexpensive to manufacture, easy to use, and yet reliable in operation.

In keeping with these objects and others which will become apparent hereafter, one feature of the present invention resides in a method of individualizing non-glued paper pads having cardboard backs from a stack which includes a plurality of cut paper layers and intermediate cardboard sheets. The following steps are proposed in accordance with the present invention for the performance of the individualizing operation:

one end of the stack which is covered by a respective cardboard end sheet is positioned against a support in such a manner that a part of the stack projects freely beyond an edge of the support;

a bending force which is directed at an inclination with respect to the stack end and has a component that points toward the edge of the support is applied against an engagement location disposed at a cut surface of the projecting part of the stack to bend the portion of the stack that is situated between the engagement location and the end sheet with attendant formation of a wedge-shaped gap between this portion and the remainder of the stack;

a number of the bent-away paper layers and intermediate cardboard layers is flipped under the influence of their elastic restoration forces back to the remainder of the stack by moving the engagement location to which the bending force is applied in the direction of the one end of the stack to such an extent that ultimately the penultimate one of the paper layers and the last one of the intermediate cardboard sheets is flipped back and only the last one of the paper layers and the cardboard end sheet associated therewith are still bent away; and thereafter the last paper layer, together with the associated cardboard sheet, is separated from the remainder of the stack by penetration into the wedge-shaped gap with attendant formation of the respective paper pad with the associated cardboard back, so that the last flipped-back intermediate cardboard sheet constitutes the end sheet of the stack during a following repetition of the individualizing operation.

Advantageously, the method according to the invention further includes the step of causing the stack to remain in contact with the support during the bending-away operation. This causing step advantageously includes utilizing solely the weight of the stack to press the stack against the support when the height of the stack is considerable. However, the stack is advantageously additionally clamped in the vicinity of the support between two of its cut surfaces. Various possibilities present themselves for the separating operation. In accordance with a currently preferred embodiment, the separating step includes peeling the paper pad off from the remainder of the stack by penetration into the gap. It is also basically possible to perform the separating step by engaging the paper pad at the region of the gap by a gripper and withdrawing the engaged pad from the remainder of the stack, such as by pulling away or lifting away.

In order to avoid back flipping of individual sheets from the respective affected paper layer during the leafing through the stack, the inventive method advantageously further includes the step of exerting on the paper layers a holding-down force which is smaller then the restoration force of the intermediate cardboard layers but greater than that of the paper layers.

A particularly easy leafing through the stack is achieved while requiring the lowest possible bending forces when the applying step includes applying the bending force in such a manner in the vicinity of an edge situated between two adjacent cut surfaces of the stack that the stack portion is bent away from the remainder of the stack at the region of one of the corners of the paper layers and of the intermediate cardboard sheets.

The present invention is also directed to an arrangement for individualizing non-glued paper pads having cardboard backs from a stack which includes a plurality of cut paper layers and intermediate cardboard sheet layers. The arrangement of the present invention advantageously includes:

a support adapted to be positioned against one end of the stack which is covered by a respective cardboard end sheet in such a manner that a part of the stack projects freely beyond an edge of the support;

at least one individualizing head periodically movable at a region of the stack that projects beyond the edge of the support against a vertical cut surface of the stack to bend the paper of the stack inclinedly toward the support, all the way to an end position thereof in which only the last one of the paper layers and the cardboard end sheet associated therewith are still bent away from the remainder of the stack while the remaining paper layers up to the last one of the intermediate cardboard sheets are flipped back to the remainder of the stack owing to their elastic restoration forces; and means for separating the respective paper pad that has been bent away from the remainder of the stack by the individualizing head from the stack.

The arrangement of the present invention advantageously further comprises a machine frame and a chute which receives the stack, is open in the downward direction, and is delimited by vertical delimiting surfaces, and the support includes a carriage which is horizontally movable to and fro on the machine frame underneath the chute and includes support rollers for the stack and means for peeling off the paper pads that have been bent away by the individualizing head. The separating means may include at least one separating member mounted on the carriage and introducible on movement of the carriage into the gap in the stack that has been formed by the individualizing head. Such separating member may include at least one separating roller.

There may be further provided an additional individualizing head similar to the individualizing head and arranged at an opposite side of the carriage therefrom, the individualizing heads being actuatable in alternation with one another. The support rollers of the carriage are advantageously arranged in two groups that are disposed mirror-symmetrically in the movement direction of the carriage with respect to a transverse central axis and are separated from one another by a central gap. Those of the support rollers that bound the central gap may simultaneously constitute separating elements that are introducible into the gap of the stack.

It is especially advantageous when the carriage includes a frame which carries the support rollers and is movable on elongated guiding elements that are stationary with respect to the machine frame. Those of the support rollers that constitute the separating elements may have a diameter that is smaller than that of the remaining support rollers. The carriage is advantageously provided with an opening at a support region thereof for the penetration of the individualizing heads therethrough. The arrangement of the invention may further include a yoke mounted on the guiding elements for the carriage, means including a first pneumatic cylinder that is stationarily mounted on the machine frame for causing the yoke to conduct limited displacement on the guiding elements, a first pneumatic cylinder that is stationarily mounted on the machine frame, and a second pneumatic cylinder mounted on the yoke and operative for moving the carriage between two end positions thereof.

There is advantageously further provided means for moving the individualizing head, including a first pneumatic cylinder that causes the individualizing head to conduct shifting movement toward and away from the stack, and a second pneumatic cylinder that causes the individualizing head, together with the first pneumatic cylinder, to conduct a pivoting movement about an axis that is stationary with respect to the machine frame between an inclinedly oriented and a vertically oriented position of the individualizing head. Alignment blocks may be arranged at an end region of the carriage being operative for abutting against a cut surface of the stack that faces oppositely from the cut surface that is being acted upon by the individualizing head. Such alignment blocks may be so constructed as to be resiliently yieldable in the movement direction of the carriage.

Additionally, it is to advantage when the arrangement further comprises a stack feeding conveyor for laterally introducing the stack into the chute. In this context, it is advantageous to further provide means for controlling the operation of the stack feeding conveyor, including a light barrier sensor that is responsive to the height of the stack in the chute. Discharging conveyor means may be arranged underneath the carriage to serve for receiving the paper pads that have been separated by the separating means from the stack. It is also advantageous when the arrangement further comprises holding-down means mounted on the individualizing head and acting on the bent-away paper layer at the gap in the stack. Such holding-down means may include at least one brush or at least one leaf spring, or is constituted by an air stream.

The solution according to the present invention is based on the recognition of the fact that the intermediate cardboard sheets, because of their inherent stiffness, possess an elastic restoration force which is a multiple of that of the paper layers so that, during bending leafing through the stack, entire layers preferentially flip back to the stack under the influence of the restoration force of the adjacent intermediate cardboard sheet. By suitable aligning and positioning of the bending forces acting on the cut surface of a stack, it is achieved in accordance with the invention that the respective last one of the paper layers, which is covered by a cardboard end sheet, is dissociated from the stack in each instance. Then, the paper pad which has been individualized in this manner can be separated from the remainder of the stack by penetrating into the thus formed gap in the stack, and can be forwarded to further processing stations.

BRIEF DESCRIPTION OF THE DRAWING

The present invention will be described below in more detail with reference to the accompanying drawings in which.

DETAILED DESCRIPTION OF THE PREFERRED EMBODIMENT

Figure 1:
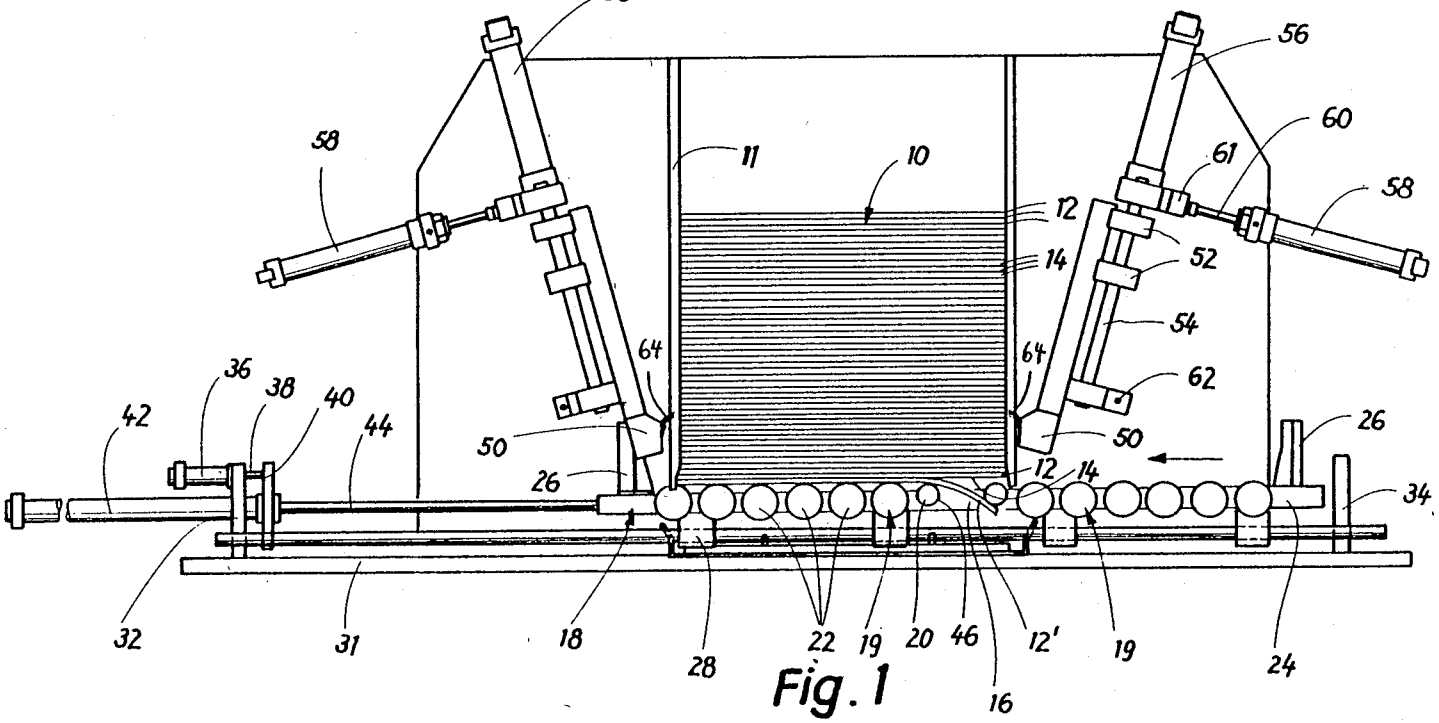
FIG. 1 is a partially sectioned side elevational view of an individualizing arrangement of the present invention.
Figure 2:
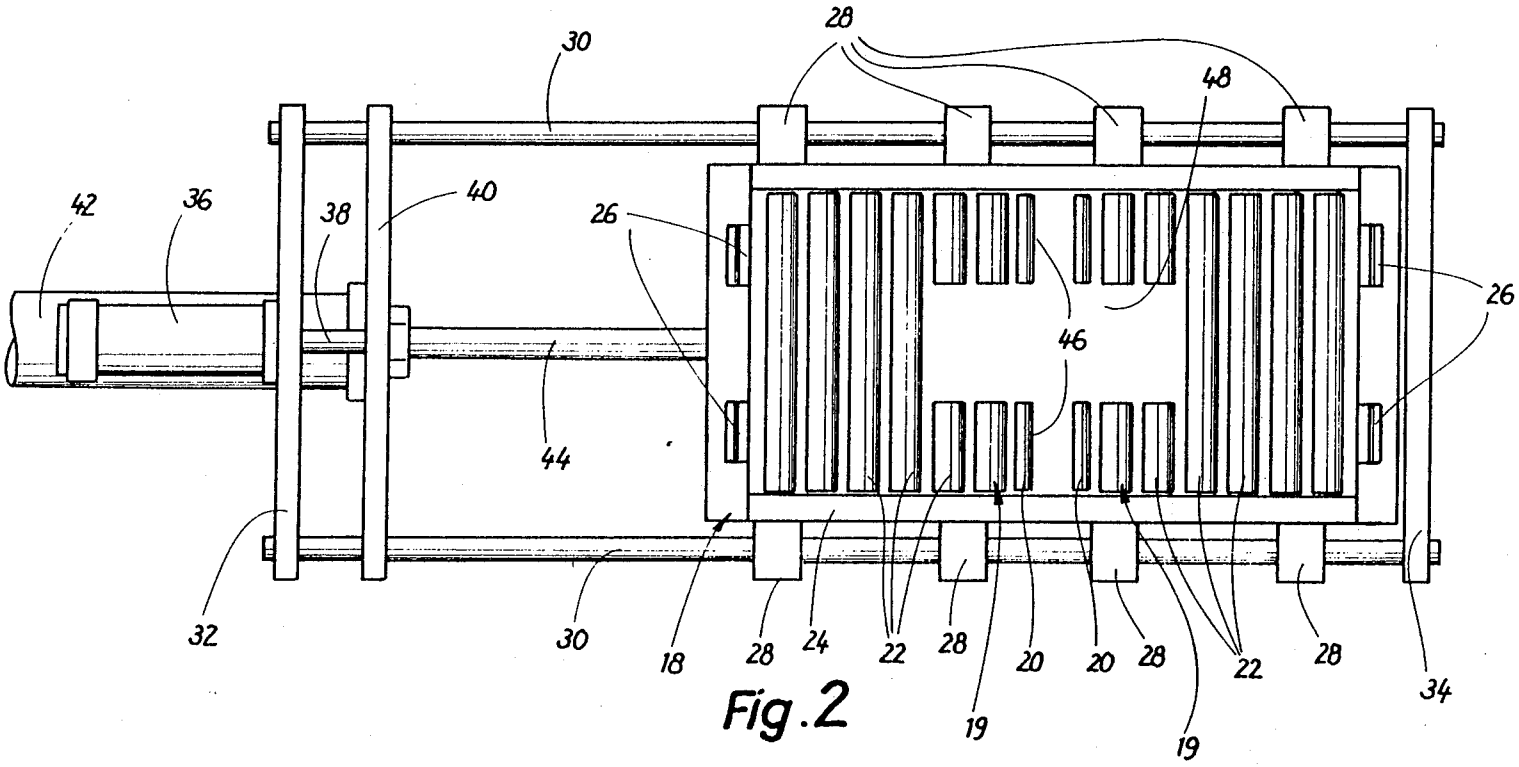
FIG. 2 is a top plan view of a support and separation carriage of the arrangement of FIG. 1.

Referring now to the drawings in detail, and first to FIG. 1 thereof, it may be seen that it depicts an individualizing arrangement of the present invention. This arrangement includes, as its main components, a machine frame, a chute 11 mounted on the machine frame 31 and having an open lower end, a carriage 18 which can be moved horizontally to an fro underneath the chute 11 by pneumatic moving means 36 and 42, as well as two individualizing heads 50 which are arranged at mutually opposite sides of the chute 11 and which can be alternatingly actuated by pneumatic auxiliary actuating means 56 and 58. The chute 11 is supplied with a paper stack 10, preferably by means of a non-illustrated supply conveyor, the operation of which is controlled by means of a light barrier that responds to the height of the remainder of the stack 10 which is still present in the chute 11.

The stack 10 has a lower end which is covered by a cardboard end sheet and which rests on rollers 20 and 22 of the carriage 18, that constitute an abutment or support for the stack 10. The rollers 20 and 22 of the carriage 18 are mounted in a frame 24. The frame 24, in turn, is provided with guiding bushings 28 that are supported for to and fro movement on support axles 30 which extend between transverse beams 32 and 34 that are stationary relative to the machine housing. The shifting of the carriage 18 is accomplished pneumatically by means of a pneumatic cylinder 42 that is arranged on a yoke 40 and that includes a piston rod 44 which is directly connected with the carriage 18. The yoke 40 itself is shiftable to a limited extend along the support axles 30 by means of a pneumatic cylinder 36 that is arranged on the transverse beam 32 which is stationary relative to the machine frame, and its piston rod 38.

The individualizing head 50 is mounted by means of lugs 52 on a rod 54 for linear shifting under the influence of a pneumatic cylinder 56, and is also mounted on the machine frame for pivoting movement about a pivoting axle 62 by means of a pneumatic cylinder 58 and a piston rod 60 that is connected to the shifting arrangement by means of a joint 61. At the central region of the carriage 18, there is provided by the use of shorter support rollers 22 an opening 48 for the penetration therethrough of the individualizing heads 50. Moreover, the rollers 20 and 22 are so mounted on the frame 24 as to constitute two roller groups 19 that are mirror-symmetrical with respect to a transverse central line. Between the rollers 20 which are arranged next to one another, and which have a smaller diameter than the remaining rollers 22, there remains a gap 46 the significance of which for the separation of the paper pads will be explained in more detail later in a function description that will be presented in conjunction with FIGS. 3*a* to 3*f* of the drawings.

The stack 10 which is to be individualized into paper pads with cardboard backs consists of a multitude of paper layers 12 that are cut at their peripheral edges, and of intermediate sheets 14 of cardboard that are positioned between the paper layers 12 and separate them from each other. During the individualizing operation, use is made of the fact that the intermediate cardboard sheets 14, because of their increased inherent stiffness, possess an elastic restoration force on bending which is greater by a multiple than that of the paper layers 12.

Figure 3A:
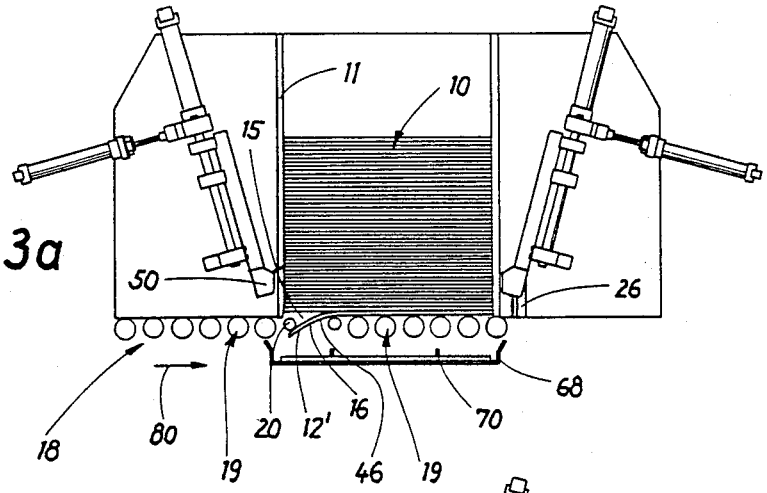
FIGS. 3*a* to 3*f* are side elevational views of a portion of the individualizing arrangement of FIG. 1 during different phases of its operation.

In the operating state which is illustrated in FIG. 3*a* of the drawings, both of the individualizing heads 50 are situated in their retracted initial positions, while the carriage 18 is situated at the left side in its end position with the yoke 40 in its extended position. In this operating state, the separating rollers 20 of the left-hand roller group 19 penetrate into a gap 15 which has been previously formed by the left-hand individualizing head 50, and the stack 10 rests on the right-hand roller group 19. During a subsequent shifting of the carriage 18 in the direction of an arrow 80, a respective paper pad 12' is peeled off by the separating rollers 20 from the paper stack 10 and propagates through a gap 46 in the carriage 18 into a discharge tray 68. From there, the thus separated paper pad 12' is transferred by means of a conveying arrangement 70 to subsequent operating stations.

Figure 3B:
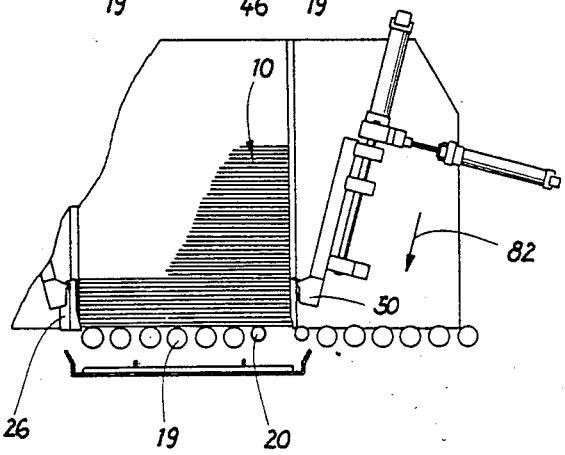

Finally, the carriage 18 reaches its right-hand end position which is illustrated in FIG. 3*b* of the drawing. In this right-hand end position, the small pneumatic cylinder 36, as well as the large pneumatic cylinder 42, are in their fully extended conditions, and alignment blocks 26 are in abutment with left-hand cut surface of the stack 10. In this operating position, the left-hand roller group constitutes the support on which the stack 10 rests in such a manner that the right-hand part of the stack 10 projects freely beyond the roller pair 20 that constitutes a support edge.

Figure 3C:
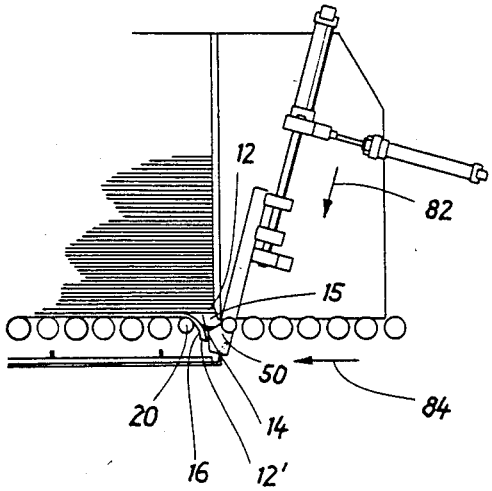

Commencing with this position, the individualizing head 50 is moved in a downwardly inclined path against the cut edge of the projecting paper stack part, until it reaches its position depicted in FIG. 3*c* of the drawing. During this movement of the individualizing head 50, the paper layers 12 that are contacted by the individualizing head 50 are bent downwardly with the attendant formation of the gap 15, and are being leafed through under the influence of the restoration force of the intermediate cardboard sheets 14. This process continues until, in the lowest position of the individualizing head 50, only one paper layer 12' with the cardboard end sheet 14 is downwardly bent, and the penultimate paper layer 12 with the associated intermediate cardboard sheet 14 has flapped back to the stack 10. A brush 64 which is so arranged on the individualizing head 50 that it penetrates into the gap 15 serves the purpose of assuring that the paper sheets of the bent-away paper layer 12' are being held down. Alternate means of assuring that the bent-away paper layer 12' is held down are a stream of air emitted through an aperture 96, as seen in FIG. 4*a*, and a leaf spring 94, as seen in FIG. 4*b*. In the downwardly displaced end position in accordance with FIG. 3*c* of the drawings, the individualizing head 50 penetrates through an opening 48 of the carriage 18. At this time, the carriage 18 is shifted, by actuation of the pneumatic cylinder 36, leftwardly in the direction of an arrow 84, so that the roller pair 20 of the right-hand roller group 19 penetrates into the gap 15 and holds the paper layer 12, in its bent position, as shown in FIG. 3*d* of the drawing.

Figure 3D:
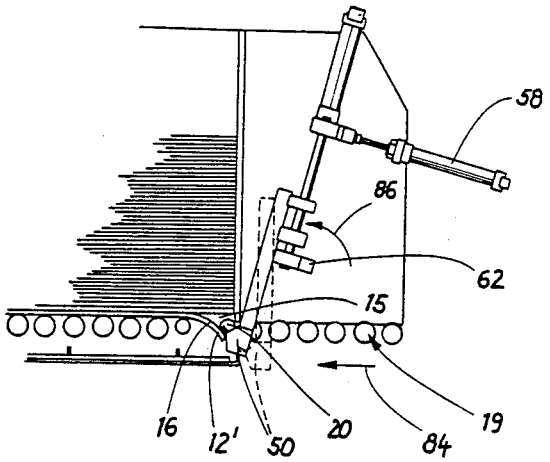
Figure 3E:
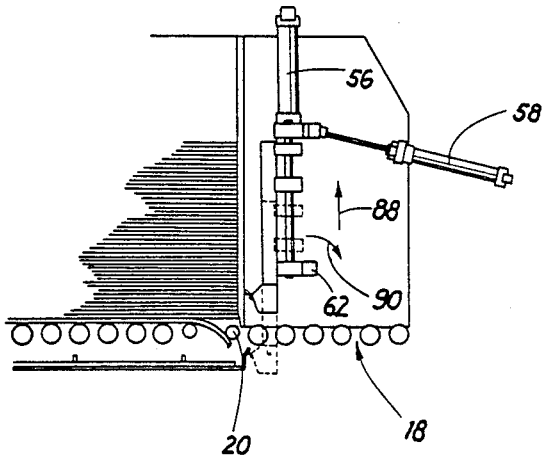
Figure 3F:
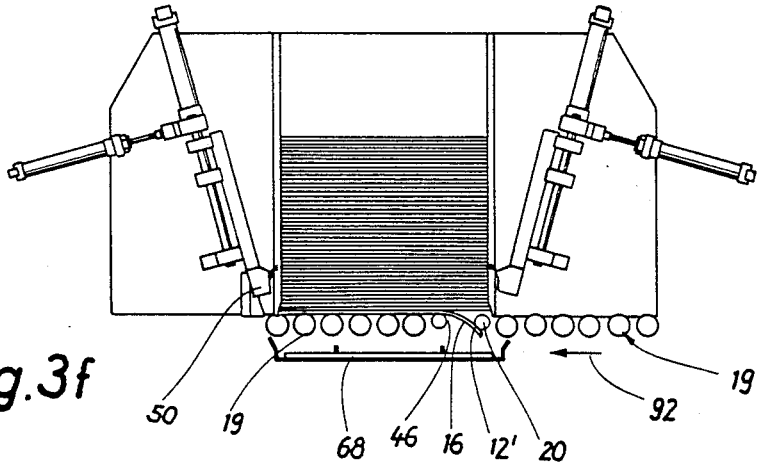
Figure 4A:
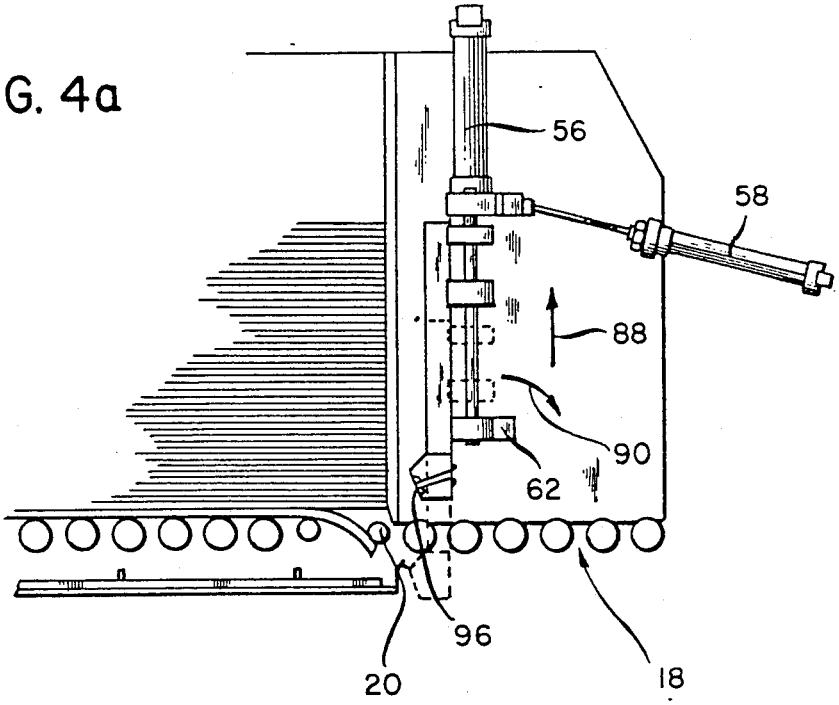
FIG. 4*a* is a side elevational view of a modified embodiment of the individualizing arrangement of FIG. 1 employing a stream of air.
Figure 4B:
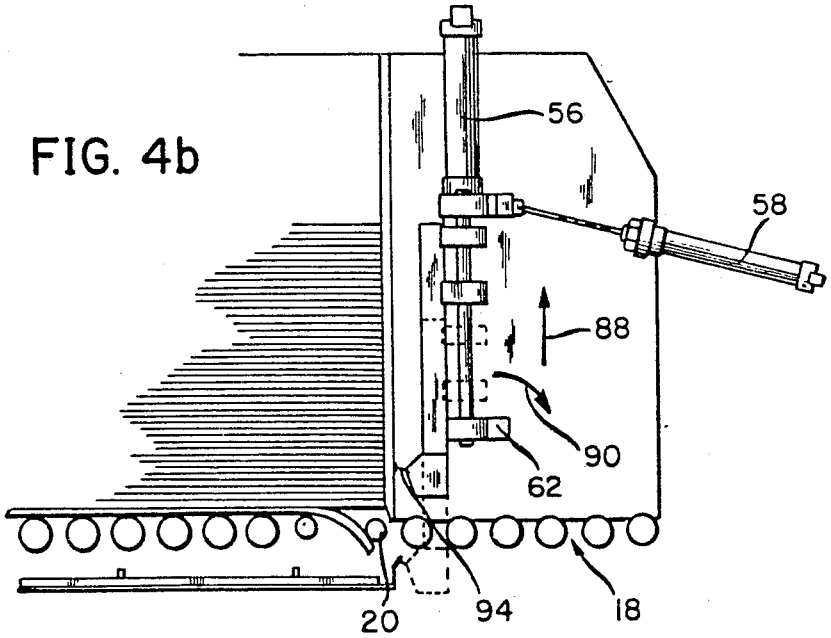
FIG. 4*b* is a side elevational view of a modified embodiment of the individualizing arrangement of FIG. 1 employing a spring.

Thereafter, the individualizing head 50 is pivoted, by means of the pneumatic cylinder 58, about the pivot axle 62 in the direction of an arrow 86 into a vertical position thereof which is indicated in FIG. 3*d* in dashed lines. In this vertical position, the individualizing head 50 is no longer in contact with the paper stack 10. Therefore, it can be displaced in correspondence with the condition illustrated in FIG. 3*e*, by means of the pneumatic cylinder 56, in the direction of an arrow 88 into its upper end position. Thereafter, the individualizing head 50 can be pivoted, by means of the pneumatic cylinder 58, in the direction of an arrow 90 into its inclined initial position which is illustrated in FIG. 3*f* of the drawings.

Subsequently thereto, the carriage 18 is displaced by means of the pneumatic cylinder 42 leftwardly in the direction of an arrow 92. During this displacement, the bent-away paper pad 12' with the end sheet 16 is peeled off from the stack 10 under the influence of the separating roller 20, and penetrates through the gap 46 into the discharge tray 68 which is situated underneath the gap 46. In the extreme left-hand end position of the carriage 18, the right-hand roller group 19 then constitutes the support on which the stack 10 rests with a portion that freely extends beyond the roller 20 which constitutes the support edge. From this point on, the above-discussed individualizing and separating operation is repeated, this time under the influence of the left-hand individualizing head 50, until the condition depicted in FIG. 3*a* of the drawing is reached again after the passage through the individual operating positions and conditions.

While the present invention has been described and illustrated herein as embodied in a specific construction of an individualizing and separating arrangement for paper pads, it is not limited to the details of this particular construction, since various modifications and structural changes are possible and contemplated by the present invention. Thus, the scope of the present invention will be determined exclusively by the appended claims.

What is claimed is:

1. An arrangement for individualizing non-glued paper pads having cardboard backs from a stack which includes a plurality of cut paper layers and intermediate cardboard end sheets, comprising a machine frame and chute which receives the stack, is open in the downward direction, and is delimited by vertical delimiting surfaces;

a support adapted to be positioned against one end of the stack which is covered by a respective cardboard end sheet in such a manner that a part of the stack projects freely beyond an edge of said support;

at least one individualizing head periodically movable at a region of the stack that projects beyond said edge of said support against a vertical cut surface of the stack to bend the paper of the stack inclinedly toward said support, all the way to an end position in which only the last one of the paper layers and the cardboard end sheet associated therewith are still bent away from the remainder of the stack, while the remaining paper layers up to the last one of the intermediate cardboard end sheets are flipped back to the remainder of the stack owing to their elastic restoration forces, thus forming a gap in the stack, and wherein said support includes a carriage which is horizontally movable to and fro on said machine frame underneath said chute and includes support rollers for the stack and means for peeling off the paper pads that have been bent away by said individualizing head; and means for separating the respective paper pad that had been bent away from the remainder of the stack by said individualizing head from the stack.

2. The arrangement as defined in claim 1, wherein said separating means includes at least one separating member mounted on said carriage and introducible on movement of said carriage into the gap in the stack that has been formed by said individualizing head.

3. The arrangement as defined in claim 1, wherein said means for separating includes at least one separating roller.

4. The arrangement as defined in claim 2, further comprising an additional individualizing head similar to said individualizing head and arranged at an opposite side of said carriage therefrom, said individualizing heads being actuatable in alternation with one another; and wherein said support rollers of said carriage are arranged in two groups that are disposed mirror-symmetrically with respect to a transverse central axis and are separated from one another by a central gap.

5. The arrangement as defined in claim 4, wherein those of said support rollers that bound said central gap constitute separating elements that are alternately introducible into the gap of the stack.

6. The arrangement as defined in claim 5, wherein said carriage includes a frame which carries said support rollers and is movable on elongated guiding elements that are stationary with respect to said machine frame.

7. The arrangement as defined in claim 6, wherein those of said support rollers that constitute the separating elements have a diameter that is smaller than that of the remaining support rollers.

8. The arrangement as defined in claim 6, wherein said carriage has an opening at a support region thereof for the penetration of said individualizing heads therethrough.

9. The arrangement as defined in claim 8, and further comprising a yoke mounted on said guiding elements for said carriage, means including a first pneumatic cylinder that is stationarily mounted on said machine frame for causing said yoke to to conduct limited displacement on said guiding elements, and a second pneumatic cylinder mounted on said yoke and operative for moving said carriage between two end positions thereof.

10. The arrangement as defined in claim 1, and further comprising means for moving said individualizing head, including a first pneumatic cylinder that causes said individualizing head to conduct shifting movement toward and away from the stack, and a second pneumatic cylinder that causes said individualizing head to conduct a pivoting movement about an axis that is stationary with respect to said machine frame between an inclinedly oriented and a vertically oriented position of said individualizing head.

11. The arrangement as defined in claim 1, and further comprising alignment blocks arranged at an end region of said carriage and operative for abutting against a cut surface of the stack that faces oppositely from the cut surface that is being acted upon by said individualizing head.

12. The arrangement as defined in claim 11, wherein said alignment blocks are so constructed as to be resiliently yieldable in the movement direction of said carriage.

13. The arrangement as defined in claim 1, and further comprising a stack feeding conveyor for laterally introducing the stack into said chute.

14. The arrangement as defined in claim 13, and further comprising means for controlling the operation of said stack feeding conveyor, including a light barrier sensor that is responsive to the height of the stack in said chute.

15. The arrangement as defined in claim 1, and further comprising a discharging conveyor means arranged underneath said carriage and operative for receiving the paper pads that have been separated by said separating means from the stack.

16. The arrangement as defined in claim 1, and further comprising holding-down means mounted on said individualizing head and acting on the bent-away paper layer at the gap in the stack.

17. The arrangement as defined in claim 16, wherein said holding-down means includes at least one brush.

18. The arrangement as defined in claim 16, wherein said holding-down means includes at least one leaf spring.

19. The arrangement as defined in claim 16, wherein said holding-down means is constituted by an air stream.

* * * * *